United States Patent [19]

Ikawa et al.

[11] 4,006,954

[45] Feb. 8, 1977

[54] ELECTRICAL CONTACTING DEVICE

[75] Inventors: Kazuo Ikawa, Tokyo; Naoki Ogawa, Yokohama, both of Japan

[73] Assignee: Nissan Motor Co., Ltd., Yokohama, Japan

[22] Filed: Sept. 17, 1975

[21] Appl. No.: 614,161

[30] Foreign Application Priority Data

Oct. 28, 1974 Japan ..... 49-124749

[52] U.S. Cl. ..... 339/8 R; 280/735; 339/10

[51] Int. Cl.[2] ..... H01R 39/00

[58] Field of Search ..... 339/8 R, 6 R, 6 RL, 339/10, 5 S; 280/150 AB, 87 C

[56] References Cited

UNITED STATES PATENTS 3,464,284 9/1969 Fergle ..... 280/87 C

*Primary Examiner*—W. Tupman
*Assistant Examiner*—DeWalden W. Jones

[57] ABSTRACT

Roller bearings ensure electrical contact and smooth rotation between a rotatable member and a stationary member even during severe vibration.

8 Claims, 2 Drawing Figures

ELECTRICAL CONTACTING DEVICE

The present invention relates to an electrical contacting device for continuously providing electrical connection between stationary and rotatable electrical conductors mounted in a motor vehicle.

It is well known to mount an air-bag system in a vehicle in which the air-bag is arranged on a steering wheel in order to preferably protect a driver in the event of vehicle collision. In this air-bag system, the system must include an electrical contacting device mounted on the steering system for transmitting an air-bag operating signal generated in the impact detecting device, positioned in a relatively stationary position of the vehicle, to the electrical gas generating device of the air-bag mounted on the rotatable steering wheel. In a collision of the vehicle, the transmittance of the air-bag operating signal from the impact detecting device into the electrical gas generating device of the air-bag must be done within several miliseconds. Therefore, the electrical contacting device used in the above-mentioned position must be made to ensure continuous connection between the impact detecting device and the air-bag system even though it has rotatory elements and bearing.

Therefore, it is a primary object of the present invention to provide an electrical contacting device which can provide reliable and continuous electrical connection between a stationary electrical conductor and a rotatable conductor rotatable relatively to the stationary electrical conductor.

Another object of the present invention is to provide an improved electrical contacting device which can be used for assuredly transmitting an air-bag operating signal, generated in the impact detecting device mounted on a relatively stationary position of the vehicle, to the gas generating device of the air-bag mounted on the steering wheel, even under the most severe impact vibrations.

Figure 1:
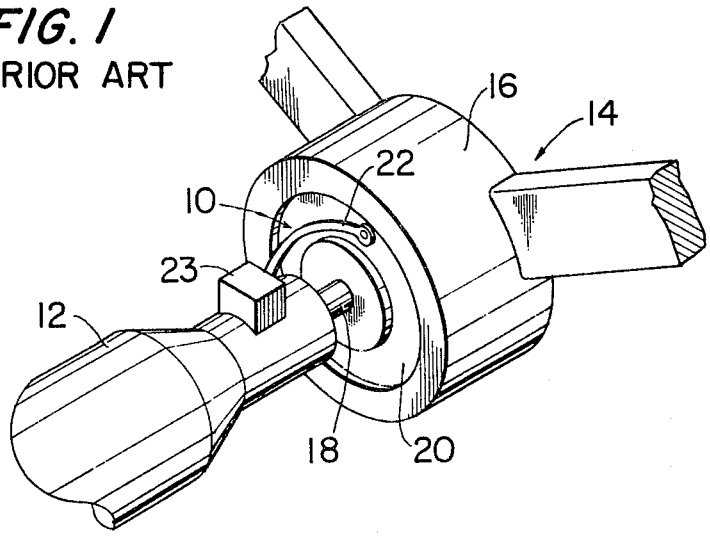
FIG. 1 PRIOR ART
Figure 2:
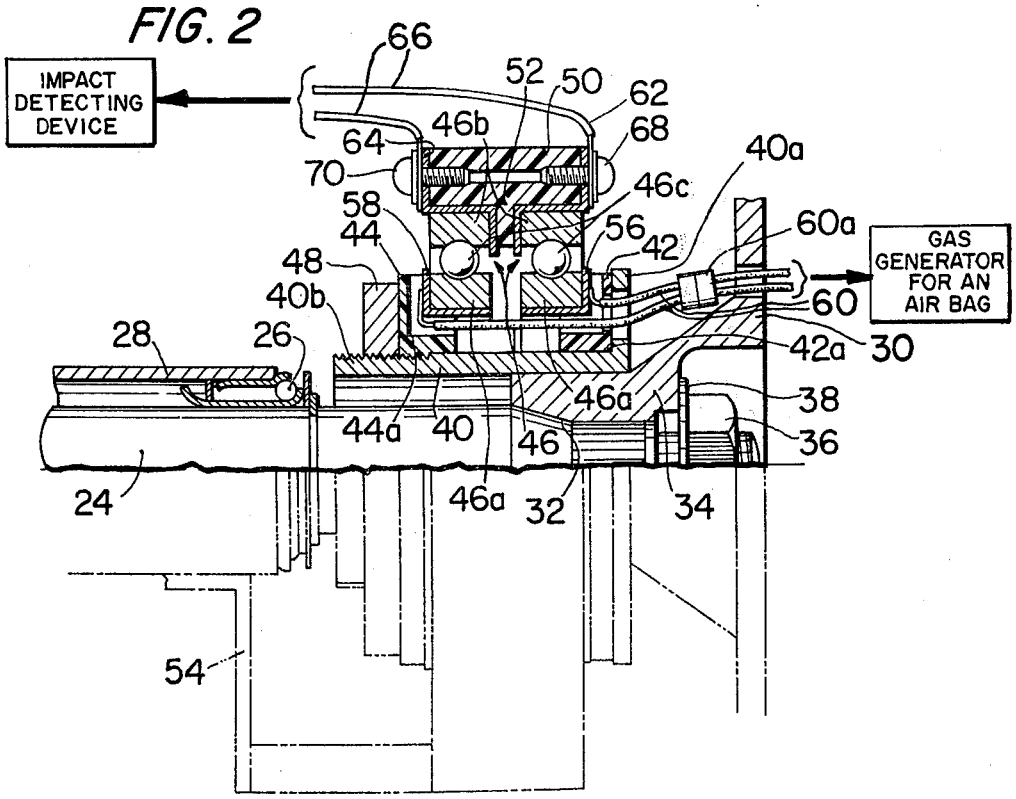

The other objects and merits of the present invention will be apparent from the following description of a preferred embodiment of the invention taken in conjunction with the accompanying drawings, in which:

FIG. 1 is a schematic perspective view of a steering wheel and steering column assembly equipped with a conventional electrical contacting device, and FIG. 2 is a schematic sectional view of a steering column and steering wheel assembly equipped with an electrical contacting device according to the present invention.

Referring now to FIG. 1, there is shown a prior art electrical contacting device generally designated by numeral 10 which is arranged between a top end portion of a steering column 12 and a steering wheel 14. The steering wheel 14 is connected at the central boss portion 16 thereof to a steering column or shaft 18 which is rotatably disposed in the steering column housing 12 in a conventional manner. The prior art electrical contacting device 10 comprises an annular conductive plate 20 which is concentrically mounted on the back portion of the boss of the steering wheel 14 and is connected to some electrical device (not shown) on the steering wheel 14. Slidably contacting at the free end thereof on the outer surface of the annular conductive plate 20 is a spring arm 22 which is fixed at the other end thereof to a switch box 23 of a trafficator lever and a head light control lever (not shown). The switch box 23 is mounted on the steering column 12 just below the steering wheel 14. The spring arm 22 is connected to the other electrical device (not shown) mounted on a stationary position of the vehicle and is mechanically biased toward the annular conductive plate 20 so that the free end constantly contacts the annular conductive plate 20.

In this prior art electrical contacting device however, the biasing force of the spring arm 22 against the annular plate 20 must be relatively small in order to render the wear between the two members 20 and 22 as small as possible. Accordingly, if the surface of the annular conductive plate 20 is not sufficiently smooth, or when the surface has been worn by the spring arm 22, and further when a vibration of the steering wheel 14 relative to the vehicle body occurs during the vehicle operation, the free end of the spring arm 22 is subject to disconnection from the outer surface of the annular conductive plate 20. Furthermore during a collision, the severe vibration may cause the above mentioned disconnection and subsequent failure of, for example, the air-bag.

Therefore, as stated hereinbefore, the present invention is presented for overcoming such drawbacks of the prior art electrical contacting device where an electrical connection between a stationary conductive member and a rotatable conductive member is required. Referring to FIG. 2, there is shown an embodiment of the electrical contacting device according to the present invention which device is incorporated with a conventional steering system. The conventional steering system is shown to include a steering shaft 24 carried by a ball bearing 26 in a steering column 28. The steering shaft 24 has a lower portion engaged with a steering gear system (not shown) and a top portion fixedly engaged with a steering wheel 40. In this figure, the steering shaft 24 is formed with a tapered top end portion snugly coupled into a bore 32 provided in a central cylindrical boss 34 of the steering wheel 40, the top end of the steering column or shaft 24 being fixedly connected with the central boss 34 by means of a nut 36 and a washer 38.

The electrical contacting device in the embodiment hereinshown comprises a cylindrical base member 40 which is coaxially and fixedly coupled to cylindrical boss 34 of the steering wheel 30 and is provided with a flange portion **40*a* radially and outwardly extending from one end thereof and a threaded portion 40*b* at the other end portion thereof. Concentrically mounted around the cylindrical base member 40 are a pair of annular inner holders 42 and 44 which are positioned to and axially spaced from each other. These annular inner holders 42 and 44 are constructed of insulating materials and are respectively formed with step portions 42*a* and 44*a* facing each other for preferably mounting thereon a pair of ball bearings 46. In order to lock these ball bearings 46 onto the pair of annular inner holders 42 and 44, a lock ring 48 is secured to the threaded portion of the cylindrical base member 40.**

A cylindrical outer holder 50 constructed of an insulating material and having a generally T-shaped cross section is mounted around the pair of ball bearings 46. As shown in the drawing, the cylindrical outer holder 50 is supported by a bracket 54 fixed to the steering column housing 28, so that the rotation thereof about the steering wheel 30 is prevented. Each of these ball bearings 46 comprises an inner race member **46*a* securely mounted on each of the step portions 42*a*, 44*a*** of the annular inner holders 42, 44, and an outer race member 46*b* securely coupled to one of the step portions of the cylindrical outer holder 50, and a plurality of rolling balls 46*c* rotatably retained within the gap portion defined between the inner race member 46*a* and the outer race member 46*b*. An electrical conducting lubricant or conductive grease is applied to suitable surfaces of the ball bearings 46 to reduce friction and wear while providing desired conductivity between the inner and outer raceway members. In this embodiment, each of the ball bearings 46 is shown as a deep-grooved bearing type. It is however to be appreciated that the each bearing to be utilized in this invention can be of any known type as long as it employs such rolling elements as balls, straight, cone-shaped or barrel-shaped cylinders.

In order to make the above construction act as an electrical contacting device, the following parts are required. A pair of annular inner conductive plates 56 and 58 each of which has a generally L-shaped cross section. These are respectively disposed between the annular inner holders 42 and 44 and the inner race members 46*a*. In this instance, as well shown in the drawing, each of the inner conductive plates 56 and 58 is arranged to surround the whole inner cylindrical surface and one of the side surfaces of each of the inner race members 46*a*. A pair of lead wires 60 communicated through a connector 60*a* with an electrical gas generator of an air-bag (not shown) mounted on the steering wheel 30 are respectively connected to the annular inner conductive plates 56 and 58 via a suitable technique such as welding. At suitable positions in the annular inner holders 42 and 44, recesses are provided (no numeral) for receiving therein the lead wires 60.

However, between the cylindrical outer holder 50 and the pair of outer race members 46*b* of the ball bearings 46 are disposed a pair of annular outer conductive plates 62 and 64 which respectively extend along the outer peripheral surfaces of the outer race members 46*b*. A pair of lead wires 66 communicated with an impact detecting device positioned on a stationary portion of the vehicle body are respectively fastened to the outer conductive plates 62 and 64 by means of bolts or screws 68 and 70.

It is now to be appreciated that the annular inner and outer conductive plates 56, 58, 62 and 64 are provided for the purpose of reducing the electrical resistance of the electrical contacting device of the invention. Therefore, if the electrical resistance does not critically effect the efficiency of the electrical arrangement, such as in a horn system, the inner and outer conductive plates 56, 58, 62 and 64 may be removed from the device. In such case, the lead wires 60 and 66 may be directly connected to the inner and outer race members 46*a* and 46*b*, respectively.

In this embodiment, the electrical contacting device is illustrated to be mounted on the boss portion of the steering wheel 30, it is also possible to mount it between the steering shaft 24 and the steering column 28. Further, it is possible to use the conventional ball or roller bearing 26 employed as a holder of the steering shaft as an electrical contacting device of the present invention.

Although, in this embodiment, a pair of ball bearings are used for the purpose of providing an electrical circuit, it is possible to employ only one bearing in a case of the horn system in which the steering shaft 24 is used as the other electrical conductor.

With the above-described construction of the electrical contacting device according to the present invention, the following advantages are possible.

1. Since the rolling resistance of the bearings used in the electrical contacting device of the invention is quite low, the contacting device will provide smooth rotational operation of the steering wheel.

2. Since a plurality of rolling elements are employed in the contacting device, load applied to each of the rolling elements or to each of the race members is relatively small thereby preventing the elements and the race members from rapidly wearing.

3. Since at least one rolling element is always in abutment with both of the outer and inner race members the electrical connection between the inner and outer race members will be maintained even when the steering wheel is subjected to shocks and vibrations thereby preventing the malfunction of the air-bag system in the event of vehicle collision.

4. Since a plurality of contact points are provided by the rolling elements between the inner race member and the outer race member, the electrical resistance between the inner and outer race member is very low. Accordingly, the contacting device is suitable for transmitting large electrical current, and may be used for other electrical arrangements.

While the invention has been shown in only one embodiment, it will be obvious to those skilled in the art that it is not so limited, but is susceptible to various other changes and modifications without departing from the spirit thereof.

We claim:

1. An electrical contacting device for providing continuous electrical connection between a first electrical device mounted on a rotatable shaft and a second electrical device mounted on a relatively stationary member, comprising:

a cylindrical base member coaxially and securely mounted on said rotatable shaft, said base member being formed with at one end thereof a flange portion outwardly extending therefrom and at the other end thereof a threaded portion;

a pair of annular inner holders concentrically mounted around said cylindrical base member and positioned to be spaced from each other, said annular inner holders being respectively formed with step portions facing each other;

at least one inner race member concentrically mounted on said step portions, said inner race member being connected with said first electrical device;

a lock ring engageable with said threaded portion of said cylindrical base member for locking said inner race member and said pair of annular inner holders against said flange portion of said cylindrical base member;

at least one outer race member concentrically positioned around and radially spaced apart from said inner race member for forming a substantially cylindrical gap between said inner and outer race members, said outer race member being securely connected to said relatively stationary member through outer race members securing means and electrically connected to said second electrical device; and a plurality of rolling elements located in said cylindrical gap for providing electrical connection between said inner and outer race members.

2. An electrical contacting device as claimed in claim 1, in which said outer race member securing means comprises:

a cylindrical outer holder concentrically and securely coupled on said outer race member; and a bracket connected at one end thereof to said cylindrical outer holder and at the other end thereof to said relatively stationary member.

3. An electrical contacting device as claimed in claim 2, in which said pair of annular inner holders and said cylindrical outer holder are constructed of insulating materials.

4. An electrical contacting device as claimed in claim 3, further comprising:

an annular inner conductive plate disposed between said inner race member and one of said annular inner holders, said annular inner conductive plate being electrically connected to said first electrical device; and an annular outer conductive plate disposed between said outer race member and said cylindrical outer holder, said annular outer conductive plate being connected to said second electrical device.

5. An electrical contacting device as claimed in claim 1, further comprising an electrically conductive grease applied to surfaces of said inner and outer inner race member.

6. An electric connection system, comprising:

a first electrical device mounted on a rotatable shaft;

a second electrical device mounted on a relatively stationary member associated with said rotatable shaft;

at least one inner race member coaxially and securely mounted on said rotatable shaft, said inner race member being electrically connected to said first electrical device;

at least one outer race member concentrically positioned around and radially spaced apart from said inner race member for forming a substantially cylindrical gap between said inner and outer race members, said outer race member being securely connected to said relatively stationary member and electrically connected to said second electrical device; and a plurality of rolling elements rotatably located in said cylindrical gap and providing electrical connection between said inner and outer race members.

7. An electric connection system as claimed in claim 6, further comprising:

an inner race member mounting means for securely mounting said inner race member onto said rotatable shaft; and an outer race member securing said outer race member to said relatively stationary member.

8. An electric connection system as claimed in claim 7, in which said first electrical device is a gas generating device of an air-bag mounted on a vehicle steering wheel, and said second electrical device is an impact detecting device.

* * * * *